United States Patent [19]

Riley et al.

[11] Patent Number: 4,643,420

[45] Date of Patent: Feb. 17, 1987

[54] FLOOR-MOUNTED EXERCISE MACHINE

[76] Inventors: Robert Q. Riley, 6835 E. Sheena Dr., Scottsdale, Ariz. 85254; David L. Carey, 13627 N. 18th Dr., Phoenix, Ariz. 85029

[21] Appl. No.: 689,131

[22] Filed: Jan. 7, 1985

[51] Int. Cl.[4] ..... A63B 21/02

[52] U.S. Cl. ..... 272/140; 272/136

[58] Field of Search ..... 272/135, 136, 137, 138, 272/139, 140, 141, 142, 143, 134

[56] References Cited

U.S. PATENT DOCUMENTS

| | | | |
|---|---|---|---|
| 2,131,570 | 9/1938 | Riley | 272/140 X |
| 2,951,702 | 9/1960 | Goodwin | 272/140 |
| 4,208,049 | 6/1980 | Wilson | 272/140 X |
| 4,231,568 | 11/1980 | Riley et al. | 272/142 X |
| 4,328,965 | 5/1982 | Hatfield | 272/140 X |
| 4,358,107 | 11/1982 | Nissen | 272/140 X |

FOREIGN PATENT DOCUMENTS

| | | | |
|---|---|---|---|
| 2149574 | 4/1973 | Fed. Rep. of Germany | 272/140 |

*Primary Examiner*—Richard J. Apley
*Assistant Examiner*—Robert W. Bahr
*Attorney, Agent, or Firm*—William H. Drummond

[57] ABSTRACT

A floor-mounted muscle exercise machine shaped and dimensioned for home use includes a floor-supported frame, a force-applying bar pivotally mounted on the frame, a body support bench tiltably mounted on the frame below the force-applying bar, a muscle-force resisting assembly and a single cable which connects the force-applying member to the muscle-force resisting asembly.

The muscle force-resisting assembly includes a torsion spring and a single cam-shaped pulley which rotates co-axially with the transverse axis of the torsion spring, both enclosed in a suitable housing attached to the fame. A single cable connects the force-applying bar to the muscle-force resisting assembly. Movement of the bar by muscle force causes rotation of the pulley against the resistance provided by the torsion spring.

1 Claim, 4 Drawing Figures

FLOOR-MOUNTED EXERCISE MACHINE

This invention relates to a muscle exercise machine.

More particularly, the invention concerns a muscle exercise machine of the type which utilizes a spring and cam to modify the muscle force required to be applied by the user in comparison to machines utilizing cam-fixed weight systems or springs alone to resist the applied muscle force.

In yet another aspect the invention pertains to an improved muscle exercise machine utilizing a spring-/cam arrangement which is of simplified and less expensive construction and which is easier to operate and adjust.

Muscle exercise machines in which the user exerts force against a portion of the machine (force application member) which is resisted by various combinations of springs, weights and cams are known in the art. For example, U.S. Pat. No. 3,188,411 to George, U.S. Pat. No. 3,298,688 to Grzybowski, U.S. Pat. No. 3,373,993 to Oja, U.S. Pat. No. 3,558,131 to Dragon and U.S. Pat. No. 3,638,941 to Kulkens disclose devices in which the user-applied muscle force is resisted by coiled springs. Further, U.S. Pat. No. 3,858,873 to Jones, U.S. Pat. No. 3,912,261 to Lambert, Sr., and U.S. Pat. No. 4,149,714 to Lambert, Jr. disclose exercise machines in which the user muscle force is opposed by movable weights acting through cam-cable systems.

Finally, our U.S. Pat. No. 4,231,568 discloses an exercise machine with a coil spring/cam arrangement for resisting the user-applied muscle force.

In addition, muscle exercise machines utilizing elastic shock cords acting through cable-cam arrangements to resist user-applied muscle force are known in the art.

In general, the muscle exercise devices which use coil springs acting through cam/cable arrangements have achieved wide commercial acceptance. Such devices have the advantage of being more compact, less expensive to construct and easier to adjust and maintain than typical muscle exercise devices of the prior art which used more complicated fixed weight-pully systems. Consequently, the coil spring devices, utilizing cams to adjust the resistive force of the coil springs, have been found to be more suited for the "residential user" market than the weight-actuated devices which are more commonly found in gymnasiums and in other public physical fitness establishments.

Despite the success of these more recent devices which utilize cam arrangements in combination with coil springs, however, there still exists a significant need to reduce the manufacturing cost and complexity and the operational complexity of these devices to provide exercise systems which are specially adapted for sale to and use by home users.

Accordingly, the principal object of the present invention is to provide a muscle exercise device of simplified and less expensive construction and which is easier to assemble and operate than prior art devices which utilize a cam arrangement to modify the muscle force required to overcome coil springs or shock cords.

Yet another object of the invention is to provide a muscle exercise device, the functional components of which are shaped and sized to permit the apparatus to be more aesthetically styled than the typical devices of the prior art which, generally, present a jumbled appearance and gross proportions.

These and other, further and more specific objects and advantages of the invention will be apparent to those skilled in the art from the following detailed description thereof, taken in conjunction with the drawings, in which.

Figure 1:
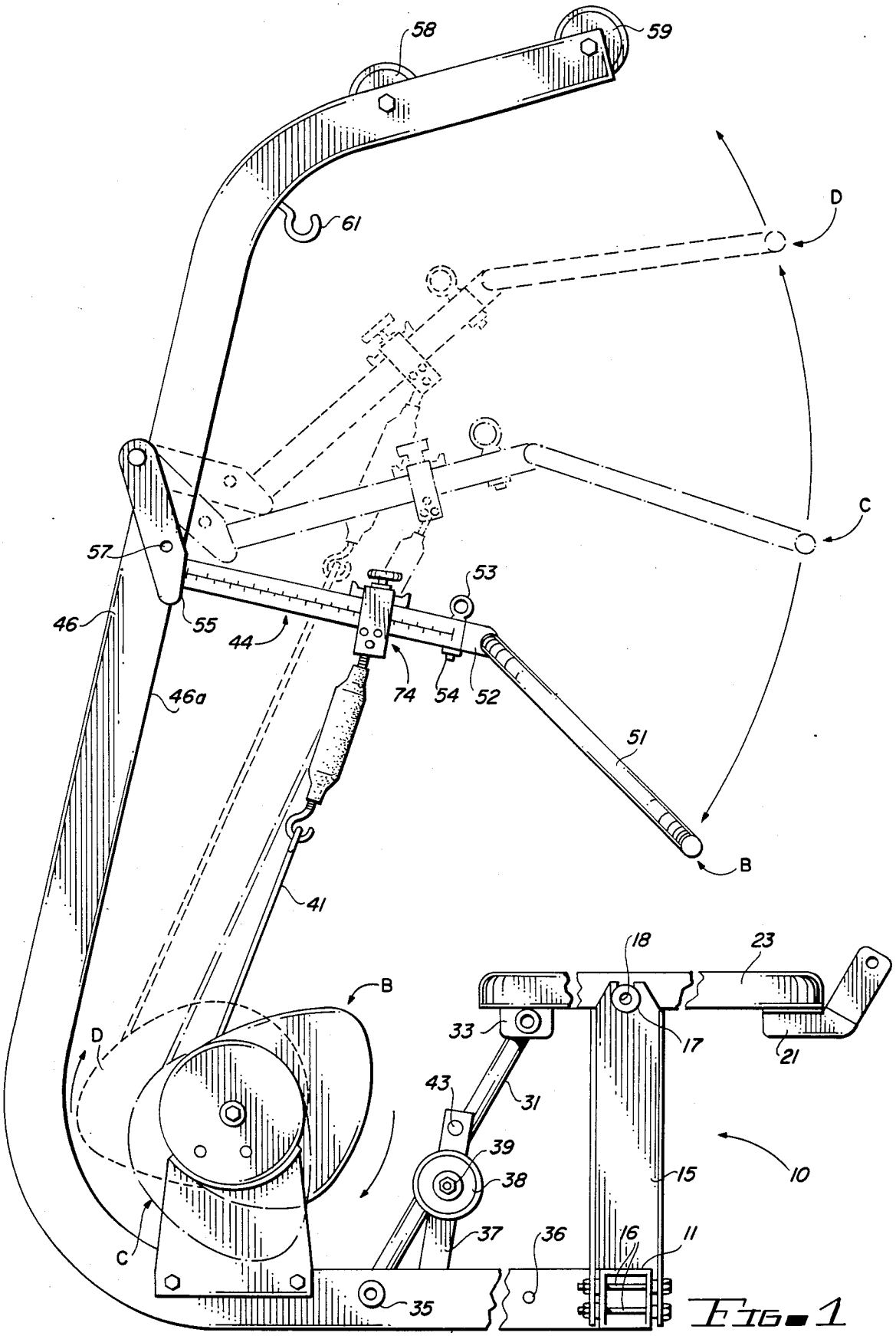
FIG. 1 is a perspective view of a muscle exercise machine which is configured in accordance with the presently preferred embodiment of the invention.
Figure 2:
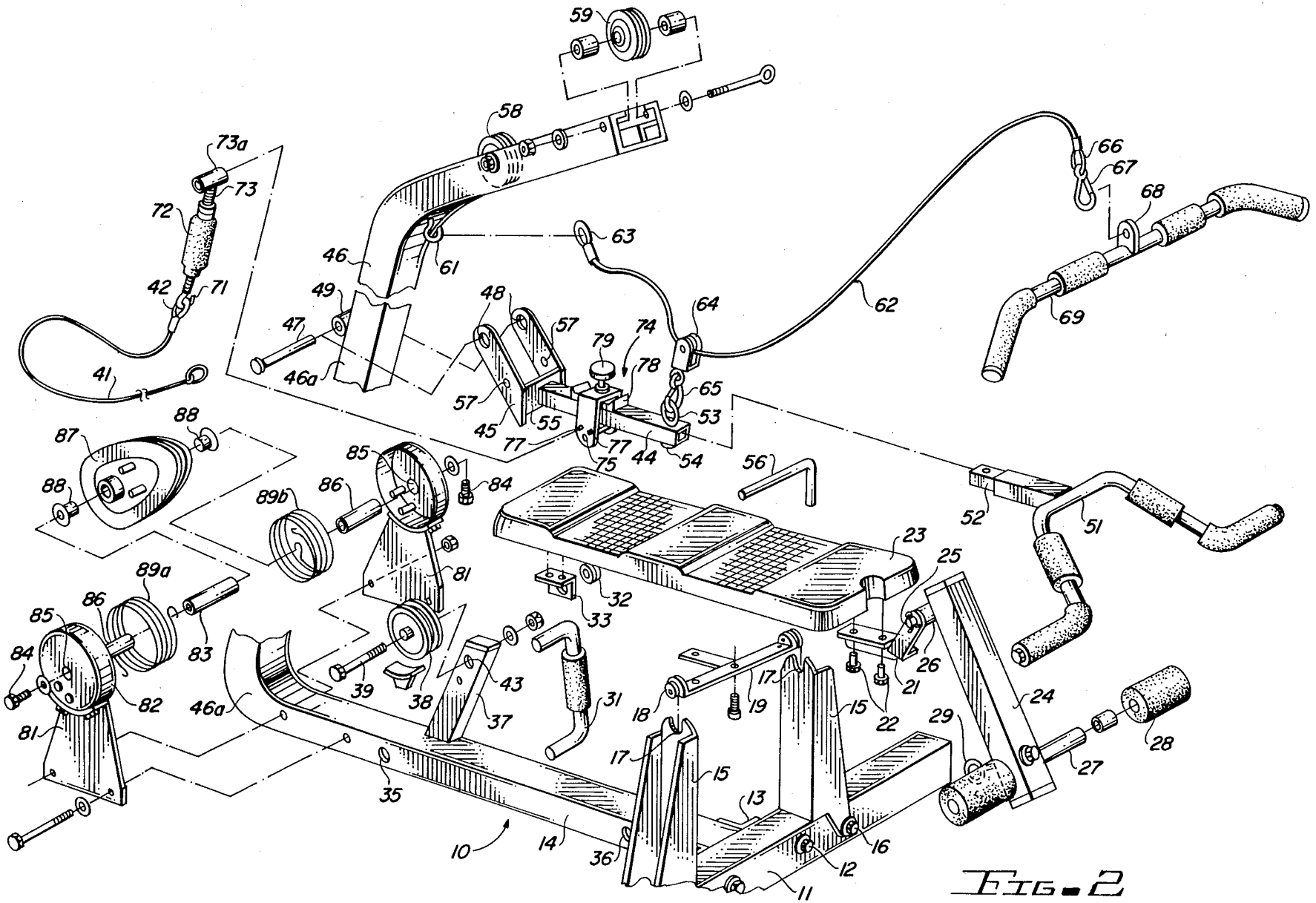
FIG. 2 is an exploded perspective view of the machine of FIG. 1.
Figure 3:
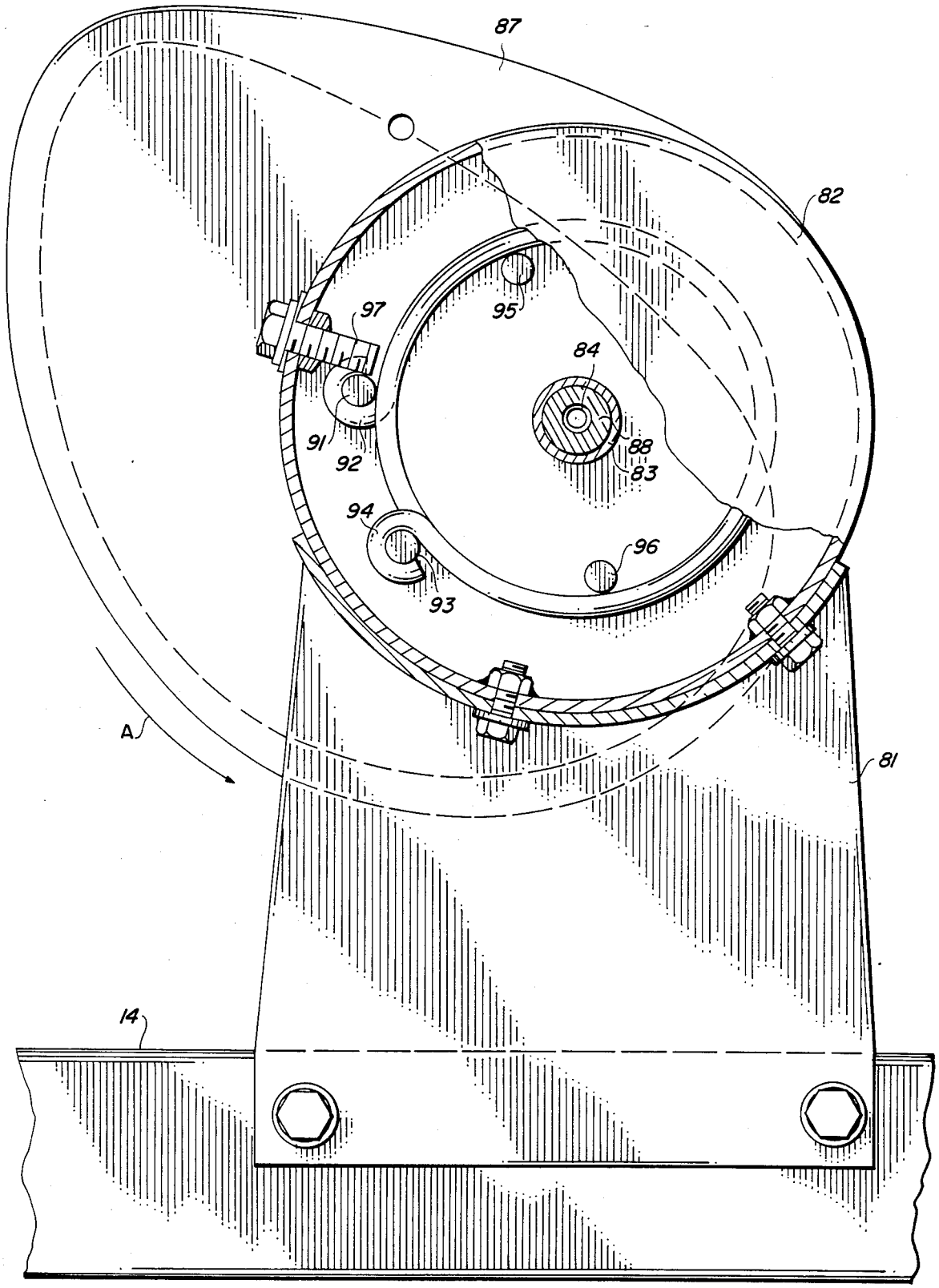
FIG. 3 is a side view of the assembled combination cam-torsion spring of the machine of FIGS. 1–2.

Briefly, in accordance with our invention, we provide improvements in exercise machines of the type generally disclosed in our issued U.S. Pat. No. 4,231,568. Such prior art machines generally include a frame, a force-applied member carried by and movable with respect to the frame, means carried by the frame to resist the physical force applied by the user to the force-applying member and a rotatable cam, operatively associated with the force-resisting means and the force-applying member, to adjust the physical force required to move the force-applying member during the exercise stroke.

According to our improvements, combination cam-spring means are provided which are carried by the frame. This combination includes a cam and torsion spring means, operatively associated with the cam to resist rotation of the cam.

As will be observed, by combining the cam with a torsion spring, a significant reduction in the complexity of the device can be achieved as numerous costly, complex and unsightly elements can be omitted from the prior art devices, without omission of their function. In particular, when the torsion spring is directly attached to the cam, in accordance with the presently preferred embodiment of our invention, the entire resultant miniature assembly can be located at an effective yet unobtrusive location on the frame, facilitating manufacture of the device and greatly reducing the number of exposed working parts, without sacrificing any of the functional features of the resultant machine.

Turning now to the drawings, in which the same elements are identified by like reference numerals in the several views, according to the presently preferred embodiment of the invention, the exercise machine includes a base portion generally indicated by reference numeral 10 consisting of a cross member 11, attached by bolts 12 to flanges 13 welded to the rear end of a forwardly extending box beam 14. Upstanding bench stands 15 are attached by means of bolts 16 to the cross member 11. The bench stands 15 are provided with rounded recesses 17 in their upper ends which are shaped and dimensioned to receive the bearing studs 18 of the bench swivel bracket 19.

A rearwardly extending leg flexion support bracket 21 is attached by means of bolts 22 to the rear end of the bench 23. The leg flexion member 24 is pivotally attached at its forward end to the bracket 21 by means of a pin 25 extending through the bearing 26 of the leg flexion member 24. A cross bar 27 extends through the rear end of the leg flexion member 24 and carries padded ankle contact pieces 28 on its outer ends. A cable connecting eye 29 is also attached to the rear end of the leg flexion member 24.

The forward end of the bench 23 is supported by means of the bench stay 31, the upper end of which is releasably received in the bearing 32 carried by a bracket 33 attached by bolts 34 to the underside of the bench 23. The lower end of the bench stay 31 can be adjustably positioned to extend through either the holes 35 or the holes 36 formed in the forwardly extending box beam 14 to adjust the slope of the bench 23 as desired.

An upstanding bearing support 37 is attached to the box beam 14. A cable sheave 38 is journaled on bolt-axle 39 extending through the support 37. The sheave 38 guides a separate cable (not shown) which is connected to the overhead cable and connected to the eye 29 of the leg flexion member 24. The lower end of the bench stay 31 can also be received in the holes 43 formed in the upper end of the support 37, to permit the bench 23 to be tilted downwardly and rearwardly of the machine.

A counterforce arm 44 has a yoke 45 at its forward end for pivotally attaching the counterforce arm 44 to the upwardly rearwardly extending mast 46 which is formed as a continuation of the box beam 14. The pivotal attachment is effected by means of the clevis pin 47 extending through the holes 48 formed in the upper ends of the yoke 45 and through the bearing 49 attached to the mast 46. Pressing handle bars 51 are carried on an extension member 52 which is slideably received into the rear end of the counterforce arm 44. The extension 52 of the pressing bar 51 is releasably located within the counterforce arm 44 by means of an eyebolt 53 which extends through the top of the counterforce arm 44, through vertically registered holes in the extension 52 and is threadedly engaged with the nut 54 welded to the underside of the counterforce arm 44. The vertical location of the counterforce arm 44 in its lowermost operative position (see FIG. 1) is determined by the contact of the horizontal face portion 55 of the yoke 45 in contact with the rear surface 46*a* of the mast 46. If desired, this lowermost vertical location can be raised by inserting pin 56 through intermediate holes 57 formed in the arms of the yoke 45.

The rearwardly extending upper portion of the mast 46 is slotted to receive sheaves 58 and 59. An eyebolt 61 is carried on the underportion of the rearward extension of the mast 46. The curling bar cable 62 is attached at one end 63 to the eyeolt 61, passes through block 64 which is releasably attached by means of the carabiner hook 65 to the eyebolt 53. The other end 66 of the curling bar cable 62 is attached by means of carabiner hook 67 to the eye bracket 68 attached to the mid portion of the curling bar 69. The resistance cable 41 can be attached at its end 42 to the eye 71 of a turnbuckle 72, the upper rod 73 of which is attached to the selector bracket 74 by means of pin 75 extending through the upper rod sleeve 73*a*. The selector bracket assembly consists of a yoke 76 which fits over the counterforce arm 44 and which is secured beneath the counterforce arm 44 by pins 77. A glide block 78 received within the yoke 76 bears on the upper surface of the counterforce arm 44. The selector bracket assembly 74 can be adjustably positioned along the length of the counterforce arm 44 and fixed in the desired location by rotating the knurled knob 79 threadedly engaged through the top of the bracket 76 to exert force on the glide block 78 to frictionally engage the selector bracket assembly 74 in the desired location on the counterforce arm 44.

Figure 4:
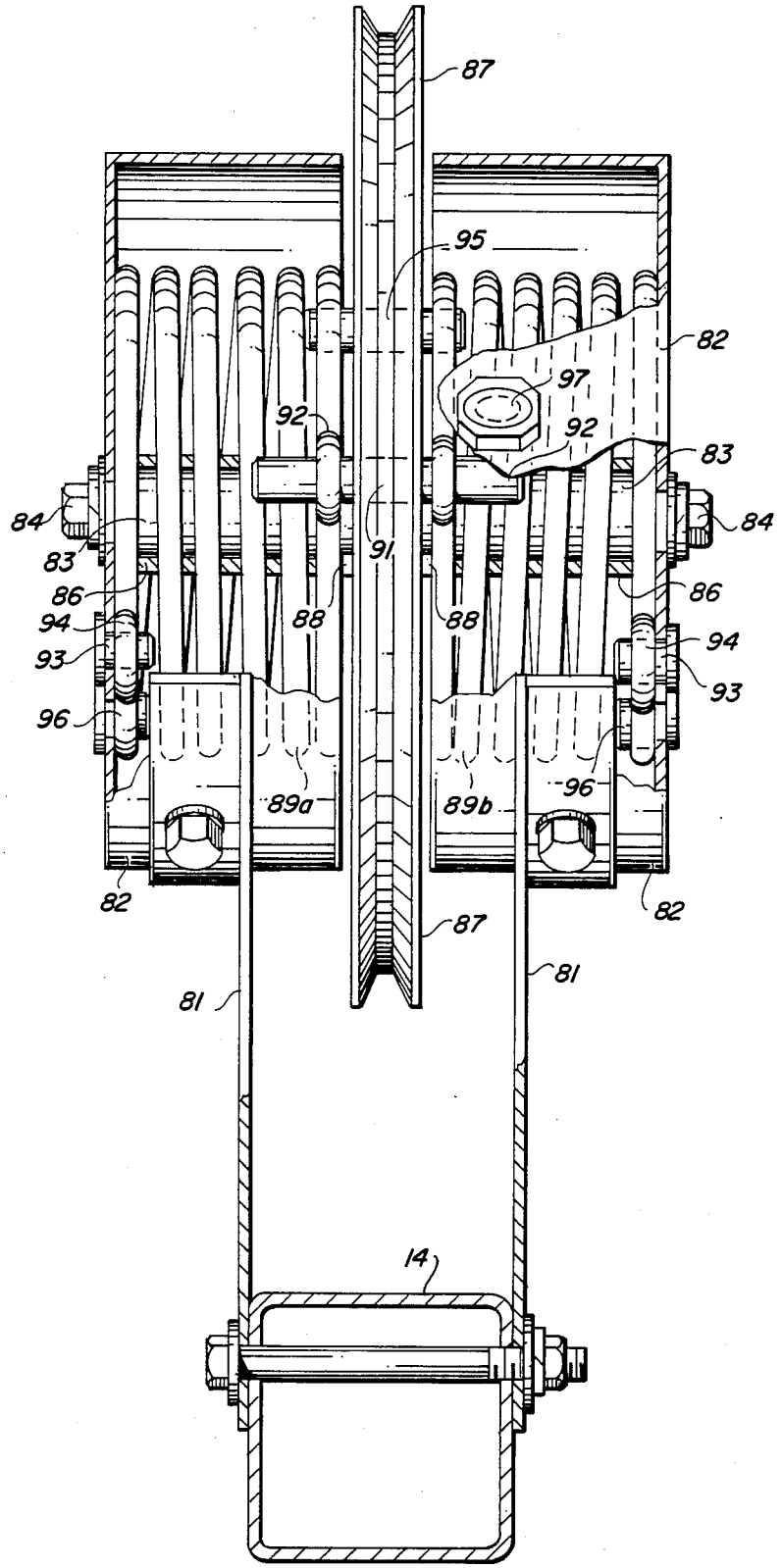
FIG. 4 is a partially cut away end view of the combination cam-torsion spring assembly of FIG. 3.

Referring now more particularly to FIG. 4, the combination torsion spring-cam assembly includes means for supporting the assembly in the form of spaced upstanding brackets 81 affixed on either side of the box beam 14 portion of the base of the machine. End caps 82 which enclose the assembly are supported by the brackets 81. An axle 83, extending transversely of the box beam 14 is supported by the end caps 82 by means of bolts 84 extending through the holes 85 in the end caps 82 and threadedly engaged with the ends of the axle 83. Cylindrical spacers 86 are received over the outboard ends of the axle 83. A cam 87 is journaled for rotation on the axle 83 by bearings 88 which are located on the axle 83 by spacers 86. A pair of torsion springs 89*a* and 89*b* are operatively connected to resist rotation of the cam 87 by means of the pin 91 extending through eyes 92 formed in the inboard ends of the springs 89 and by pins 93 extending inwardly of the end caps 82 through eyes 94 formed in the outboard ends of the torsion springs 89. Guide pin 95 extending through the cam 87 and guide pins 96 extending inwardly of the end caps 82 locate the torsion springs 89 during radial expansion and contraction thereof under application and relaxation of torsional loads.

After initial assembly of the components, with the torsion springs 89 untorqued, the cam is rotated in the direction of the arrow A and the preloading bolts 87 are then screwed inwardly of the end caps 82 to effect a stop for the pins 91, to maintain a selected "pre-loading" of the torsion springs 89. The radial position of the preload bolts 97 on the periphery of the end caps 82 determines the initial torque which must be applied to the cam 87 to overcome the torsion springs 89. As will be apparent to those skilled in the art, the initial torque can be varied to suit the requirements of the individual user by providing multiple locations for the insertion of the preloading brackets 97.

The operation of the exercise machine is further illustrated in FIG. 1 which shows the pressing bar 51 at its normal initial position, indicated by the arrow B, the mid position indicated by the arrow C and the full-extension position indicated by the arrow D. The curling bar and leg flexion members are omitted from FIG. 1 for purposes of clarity of illustration. As will be apparent, as the torque springs expand and resistance increases with rotation of the cam, the cam guides the connecting cable 41 outwardly away from the axle at a rate determined by the shape of the cam surface which adjustably modifies the force required to overcome the spring resistance to compensate or otherwise adjust for the increased torque exerted by the torsion springs.

Having described our invention in such terms as to enable those skilled in the art to understand and practice it, and having identified the presently preferred embodiment thereof, we claim:

1. A muscle exercise machine, shaped and dimensioned for home use, comprising:

(a) a floor-supported frame, including
  (i) an elongate rail having
    a horizontal floor-supported lower portion, and
    an upwardly extending upper portion,
  (ii) a cross-member carried transversely of said lower rail portion to maintain said upper portion perpendicular to the floor;

(b) a body support bench tiltably mounted for movement in a vertical plane above said lower rail portion;

(c) a force-applying bar, movable by muscle force in a vertical plane, pivotally attached at its forward end to said upper rail portion and extending rearwardly above said bench and said lower rail;

(d) muscle-force resisting means carried by said frame, including:

(i) a spring housing fixed to said frame, (ii) a torsion spring enclosed by said housing, the fixed end of which is attached to said housing, (iii) a single cam-shaped pulley in said housing, journaled for rotation co-axially with the transverse axis of said torsion spring;

and (e) a single cable connecting said pulley and said force-applying bar such that movement of said bar causes rotation of said pulley against the resistance provided by said torsion spring.

* * * * *